US005085441A

United States Patent [19]

Jova

[11] Patent Number: 5,085,441

[45] Date of Patent: Feb. 4, 1992

[54] METHOD OF PLAYING A BOARD GAME

[76] Inventor: Fernando J. Jova, 599 W. Westfield Blvd., #25, Indianapolis, Ind. 46204

[21] Appl. No.: 585,225

[22] Filed: Sep. 19, 1990

[51] Int. Cl.[5] ..... A63F 3/00

[52] U.S. Cl. ..... 273/248; 273/263; 273/146

[58] Field of Search ..... 273/248, 263, 244, 249, 273/254, 258, 255, 246

[56] References Cited

U.S. PATENT DOCUMENTS

| | | | |
|---|---|---|---|
| 715,474 | 12/1902 | Gaylor | 273/248 |
| 4,059,276 | 11/1977 | Weniger | 273/243 |
| 4,070,026 | 1/1978 | Cambardella | 273/254 |
| 4,171,814 | 10/1979 | Tamano | 273/243 |
| 4,194,741 | 3/1980 | Rea | 273/243 |
| 4,323,248 | 4/1982 | Salvatore | 273/236 |
| 4,570,938 | 2/1986 | Ferris et al. | 273/243 |
| 4,861,040 | 8/1989 | Peterson | 273/241 |

*Primary Examiner*—Benjamin Layno
*Attorney, Agent, or Firm*—Willian Brinks Olds Hofer Gilson & Lione

[57] ABSTRACT

A board game of the type which combines the use of a game board having a playing surface divided into large numbers of subunits with one or more playing pieces which are movable over the playing surface from subunit to subunit during the course of a game in order to achieve a particular objective. The game includes a random movement piece movable periodically in an unpredictable manner during the course of the game and one or more counters for each player which are also movable periodically during the course of the game. The object of the game is for a player to move his counters so as to interact with the random movement piece in a specified manner and to then move the counters to an exit position on the game board, and the first player that moves all of his counters to the exit position wins the game.

12 Claims, 5 Drawing Sheets

METHOD OF PLAYING A BOARD GAME

BACKGROUND OF THE INVENTION

1. Field of the Invention

The present invention relates generally to a board game, and, more particularly, to a game of the type which combines the of game board having a playing surface divided into a large number of subunits with one or more playing pieces which are movable over the playing surface from subunit to subunit during the course of the game in order to achieve a particular objective.

2. Description of the Prior Art

Board games are a popular source of entertainment played by persons of all ages throughout the world. In one popular type of board game, two or more players move their playing piece or pieces over the board in an effort to be the first to reach a particular objective; e.g., to move their playing pieces from a starting position to a finishing position. Although enjoyable to play, such games tend to be primarily games of chance with very little, if any, skill required.

To increase the excitement and pleasure of playing such games, it is known to introduce various obstacles into the path of movement of the playing pieces, or to provide the players with various options as to how their playing pieces may be moved. Notwithstanding these variations, however, there is still only a limited degree of skill required in most such games, and this frequently results in players quickly becoming bored or otherwise disenchanted with the game.

SUMMARY OF THE INVENTION

The present invention provides a game of the type in which players move one or more playing pieces or "counters" over the playing surface of a game board in an effort to be the first player to achieve an objective, and which combines elements of chance with a substantial amount of skill.

A board game according to the present invention is generally intended to be played by two or more players and comprises a game board having a playing surface which includes a plurality of subunits thereon, one or more random movement pieces movable periodically in an unpredictable manner from subunit to subunit during the course of the game, one or more counters for each player which are movable periodically from subunit to subunit during the course of the game from a starting position toward an objective, which objective includes an interaction with at least one of the one or more random movement pieces, first designating means for designating the movement of the one or more counters, and second designating means for designating the movement of the one or more random movement pieces.

In the board game of the present invention, the first player to achieve the objective with each of his one or more counters wins the game. Achieving the objective, however, includes an interaction between each counter and a random movement piece; and because the one or more random movement pieces are periodically moved during the course of the game, the counters must "chase" after a random movement piece in order to interact with it. The necessity of interacting with a piece which moves periodically in an unpredictable manner during the course of the game introduces a substantial amount of skill into the game with regard to the movement of the counters by the players, and results in a game which is highly competitive and fun to play.

In accordance with a presently preferred embodiment of the invention, the playing surface is divided up into a large number of subunits such as an array of 21 squares by 21 squares. The game includes a single random movement piece and a plurality of, for example, five, counters for each player. At the start of play, each player's counters are positioned along a different side of the game board on designated starting or entry squares. A plurality of designated exit squares are provided for each player on the opposite side of the board for each player. The object of the game is for each player to first move his counters onto a square adjacent the random movement piece to thereby earn "achievement" status for his counters; and after obtaining achievement status, the player then endeavors to move his counters (then called "Achievement pieces" or "A-pieces") off the board by moving them to a designated exit square. The first player to convert all of his counters to A-pieces and to then move all of his A-pieces off of the board is the winner.

The random movement piece is preferably moved in a completely random manner in accordance with instructions provided by the second designating means after each player takes his turn. For example, after taking his turn, each player operates the second designating means which indicates both the number of squares that the random movement piece is to move and the direction in which it is to move. The first designating means is operated by each player during his turn and indicates to the player the number of spaces that he must move his counters during his turn. The player, however, determines which of his counters to move and their direction of movement; and this provides the game with a substantial skill factor inasmuch as a player must try to predict at least the general area in which the random movement piece might be located when his next turn comes up so that he can position his counters in the best possible location for his next turn.

The board game according to the present invention is easy to learn, but rather difficult to master. The rules of the game can also be varied in numerous ways to increase the enjoyment of playing the game.

Specific details and further advantages of the invention will be set forth hereinafter in conjunction with the following detailed description of a presently preferred embodiment.

DETAILED DESCRIPTION OF A PRESENTLY PREFERRED EMBODIMENT

In order to provide a clear understanding of the board game of the present invention, the game will initially be described in terms of its presently preferred components and a presently preferred set of rules. It should be understood, however, that it is intended that both the components and the rules may be varied in numerous respects without departing from the invention, and several contemplated variations will be described herein following the description of the preferred embodiment.

Figure 1:
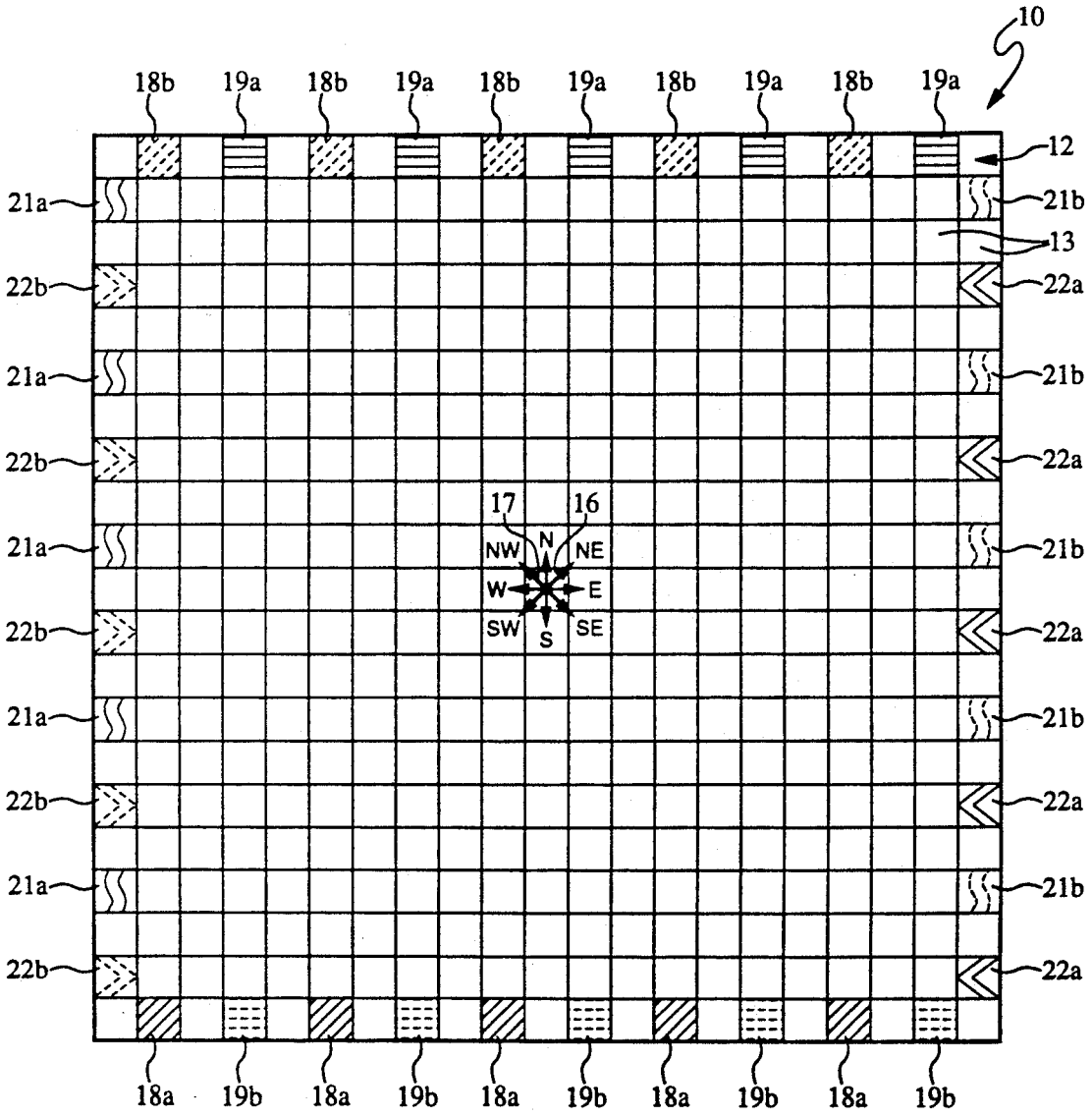
FIG. 1 is a plan view of a game board for playing the board game according to a presently preferred embodiment of the present invention.

FIG. 1 illustrates a game board suitable for playing the game of the present invention. The board is generally designated by reference number 10 and provides a playing surface 12 on which the game is to be played. Playing surface 12 is of generally square shape and is divided into a large number of congruent square playing spaces or subunits 13 (hereinafter referred to as "squares") forming files and transverse rows of squares. In the illustrated embodiment, playing surface 12 is divided into a total of 441 squares arranged in an array of 21 squares by 21 squares.

Although not illustrated in the figures, at least most of the squares are preferably arranged in some repetitious pattern such as of alternating color in a manner similar to a checkerboard so that adjacent squares can be readily differentiated from one another by the players to facilitate movement of playing pieces over the playing surface.

One square, preferably the centrally positioned square 16 on the playing surface, is used as the starting point for a random movement piece which will be described more fully hereinafter. As illustrated in FIG. 1, square 16 may be distinguished from other squares on the playing surface by a symbol 17 designating eight possible directions of movement of the random movement piece (the piece can move in either direction horizontally, vertically or diagonally).

Also provided on playing surface 12 are five entry squares and five exit squares for each of four players. For ease in illustration, the entry squares 18*a* for player No. 1 are identified by solid slanted lines and the exit squares 18*b* for player No. 1 are designated by dashed slanted lines. In a similar manner, the entry and exit squares 19*a* and 19*b* for player No. 2 are identified by solid and dashed horizontal lines, respectively; the entry and exit squares 21*a* and 21*b* for player No. 3 are identified by solid and dashed curved lines, respectively, and the entry and exit squares 22*a* and 22*b* for player No. 4 are identified by solid and dashed zigzag lines, respectively.

As shown in FIG. 1, the five entry squares for each player are evenly spaced along a different edge of the board, and the five exit squares for each player are evenly spaced along the opposite side of the playing board from his respective entry squares. In practice, the entry and exit squares for each player can be of a particular color or be provided with some other easily identifiable feature to permit the entry and exit squares of each player to be distinguished from one another.

Figure 2:
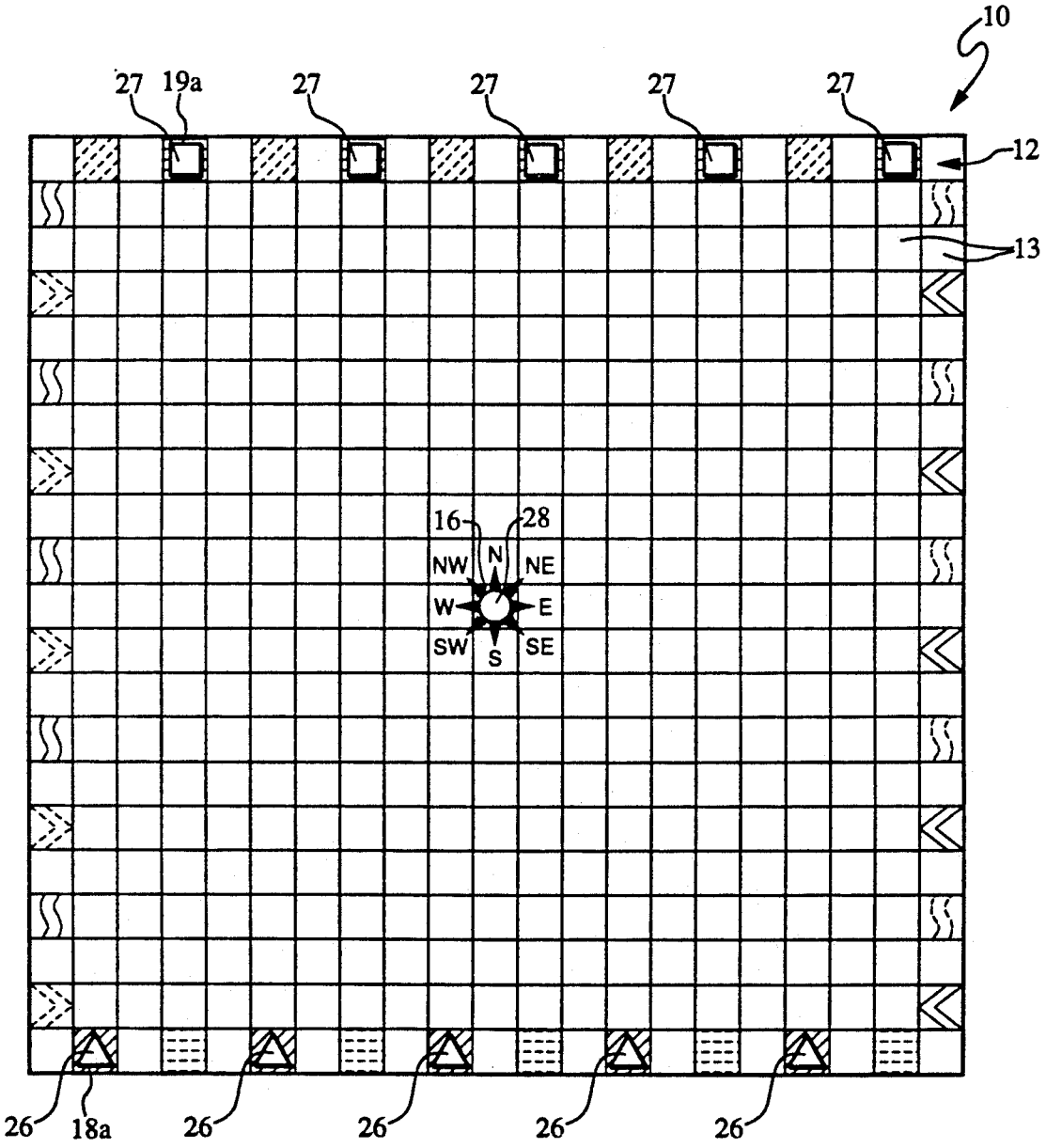
FIG. 2 illustrates the game board of FIG. 1 with playing pieces of the game positioned for commencement of the game.

FIG. 2 illustrates playing surface 12 with playing pieces of the game positioned for commencement of a game to be played by two players. As shown, player No. 1 has five counters 26, with one counter placed on each entry square 18*a*. Player No. 2 likewise has five counters 27 positioned on each entry square 19*a*. If additional players were playing the game, they would also position their counters in their respective entry squares. A single random movement piece 28 is placed in central square 16.

Although the counters for each player are differentiated by shape in FIG. 2, preferably they are differentiated by color, and each player's counters can conveniently be the same color as his entry and exit squares. The random movement piece is different in shape, color or the like from any of the counters so it may be readily distinguished from the counters.

The object of the game according to the preferred embodiment is for each player to move each of his counters onto a square adjacent to the random movement piece (hereinafter "RM piece") to thereby earn "achievement" status for his counter. The player will then try to move his achievement pieces (hereinafter "A-pieces") to one of his exit squares with their achievement status intact. The first player to convert all of his counters to A-pieces and to move all of his A-pieces safely off the board wins the game.

Figure 6A:
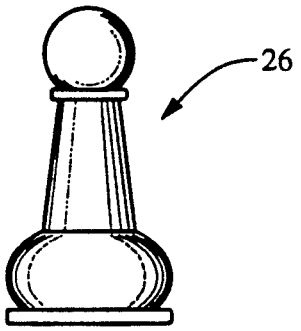
FIGS. 6A and 6B schematically illustrate a counter and a corresponding achievement piece, respectively, for a player of the game.
Figure 6B:
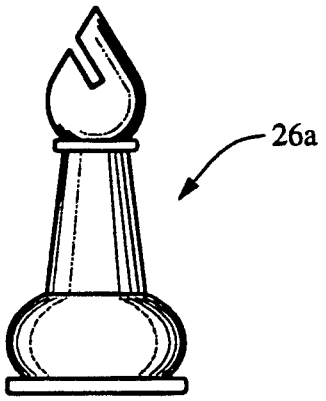

When a counter earns achievement status, it must be signified in some suitable manner. A preferred manner of designating the achievement status of a particular counter is to replace it with a different piece. For example, each player's counters can be represented by a piece similar to a pawn used in a chess game such as counter 26 shown in FIG. 6A. When a counter achieves its achievement status, the pawn can be replaced by a bishop of the same color such as achievement piece 26*a* shown in FIG. 6B, thereby readily indicating its status. Extending the chess game analogy, the RM piece can be represented by a king or a queen.

Figure 3A:
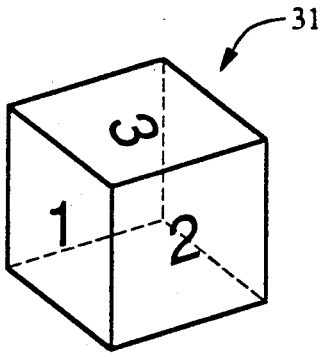
FIGS. 3A and 3B, and 4A and 4B illustrate first and second designating means, respectively, which may be used in playing the game of the present invention.
Figure 3B:
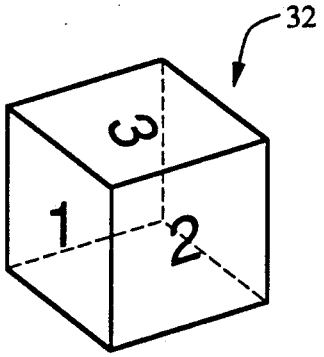
Figure 4A:
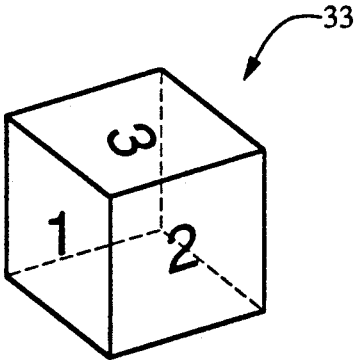
Figure 4B:
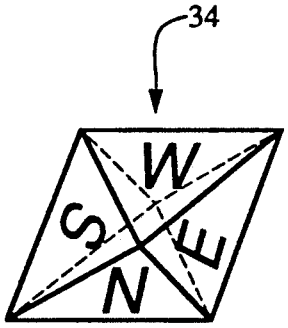

Also included in the game are first and second designating means for designating the movement of the counters and the random movement piece, respectively. The first designating means, shown in FIGS. 3A and 3B, preferably comprises two standard dice 31 and 32 having six sides and having numbers one through six on its six sides (only the three visible sides are numbered in the figures). The second designating means, shown in FIGS. 4A and 4B, includes one standard six-sided die 33 having numbers one through six on its sides, and an octagonal die 34 having eight sides. The octagonal die has eight directions printed on its eight sides, north, south, east, west, northwest, southwest, northeast, southeast (again, only the four visible sides are lettered N, S, E, W in the FIGURE).

To determine the movement of the RM piece, dice 33 and 34 are thrown. Die 33 identifies the number of squares that the RM piece is to move and die 34 identifies the direction in which it is to move as indicated by symbol 17 in square 16. To determine the movement of the counters, the first designating means is thrown. Each die 31 and 32 determines the number of squares that one of the five counters of the player is to be moved, and the player himself determines which two of his five counters to move and in which direction they are to be moved. The counters can also be moved horizontally, vertically or diagonally. Thus, the RM piece is moved in a completely unpredictable, random manner and the counters are moved in a manner which is random only with respect to the number of spaces they are to be moved, the player being able to select which of his counters to move and in which direction to move them.

The game, according to the present invention, is played as follows. At the beginning of play, each player positions his five counters on his respective entry squares and the RM piece is placed in central square 16. The players roll dice 31 and 32 to determine who will move first with play continuing clockwise. During each turn, each player throws the two dice 31 and 32 and moves any two of his counters by the number of squares indicated on the two dice, and in the direction of his choosing. Following his turn, the player then throws dice 33 and 34 and moves the RM piece according to the instructions given by the dice. Preferably, each player throws dice 33 and 34 three times and moves the RM piece three times following his turn, as this results in substantial movement of the RM piece and increases the unpredictability of where the RM piece will end up on the board following each player's turn.

The sequence of the game involves each player throwing dice 31 and 32 for his own move and then throwing dice 33 and 34 three times for the RM piece's move and the next player then taking his turn.

As indicated above, the object of the game is for each player to convert his counters to achievement status by moving to a square adjacent to the RM piece and, thereafter, to move the A-pieces to one of the player's exit squares. Once achievement status is obtained, an A-piece can move to any exit square for that particular player.

Substantial skill is introduced into the game because of the unpredictable random movement of the RM piece during the play of the game. Each player endeavors to select which two of his five counters to move during each turn and in which direction to move them so as to maximize his chances of moving his counters closer and closer to the RM piece as it moves randomly across the playing surface during the course of the game so that he may ultimately be able to move his counters to a space adjacent the RM piece before his opponents are able to do so with their counters.

As the game progresses and the RM piece moves around the board as determined by throwing dice 33 and 34, it may contact or push a counter or A-piece that happens to be in its path. If it should push an A-piece, that piece immediately loses its achievement status and reverts to a regular counter such that that counter must again obtain achievement status before it can progress toward an exit square. A counter cannot obtain achievement status due to the RM piece moving adjacent to it, but must itself be moved adjacent to the RM piece during a player's move. Neither counters nor A-pieces can push, capture, kill or jump over other counters, or A-pieces or the RM piece.

Although it is possible to require that an exit take place only with a die roll that equals the number of squares that the A-piece has to move, it is preferred that this not be required. For example, if an exit square is four squares away from an A-piece, the A-piece is allowed to exit the board if the roll of die 31 or 32 is either a four, five or six.

Figure 5A:
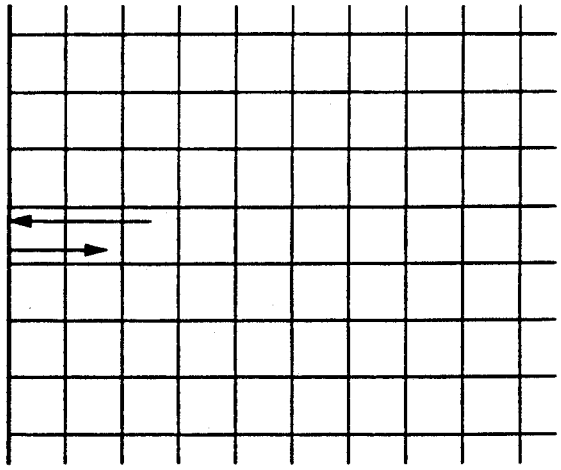
FIGS. 5A, 5B and 5C schematically illustrate a portion of the game board of FIG. 1 to assist in explaining movement capabilities of the random movement piece.
Figure 5B:
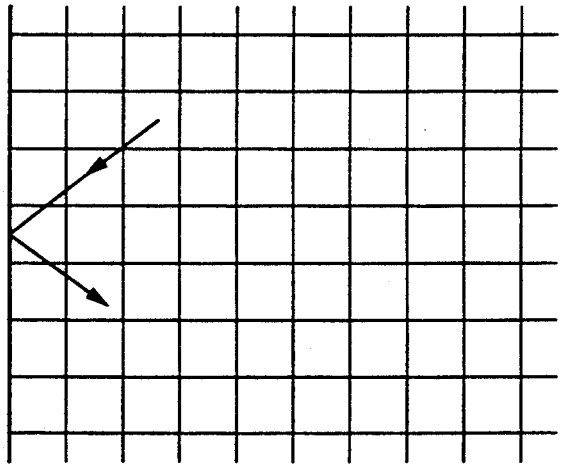
Figure 5C:
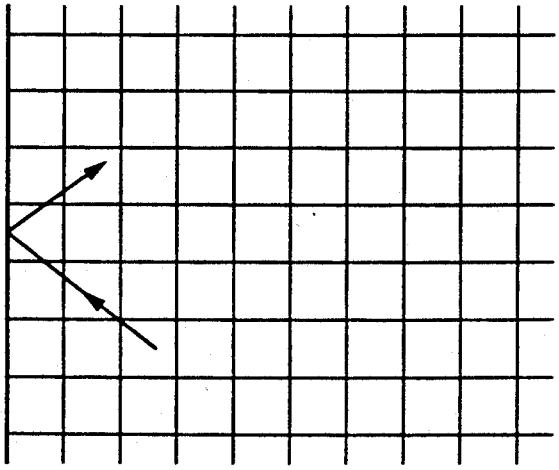

It should be noted that the RM piece 28 can move in any of eight directions and, in its movement, it may impinge upon the side of the game board in any of three configurations; straight on or at a 45° angle upwardly or downwardly relative to a straight-on move. As schematically shown in FIG. 5A, if the RM piece impinges on the edge of a board straight on, it rebounds straight back until it has completed its assigned number of moves. If it impinges the edge of the game board at a 45° angle, it rebounds off the edge at an angle of 90° from the direction at which it impinges the edge as shown in FIGS. 5B and 5C until it completes its required number of moves. The counters cannot move beyond or rebound from an edge of the board; and, thus, if a counter is only two spaces from an edge of the board and a three is thrown on the die, that particular counter cannot be moved in the direction that would cause it to impinge the edge of the board, but must be moved, if it is moved, in some other direction. Similarly, a counter cannot be moved in ways that will cause it to impinge upon another counter of the same or another player nor upon the RM piece. It must end its move adjacent an RM piece in order to acquire achievement status.

While what has been described above constitutes a presently preferred embodiment of the invention, as indicated above, numerous variations in both the components and the rules of play of the game are possible and are intended to be covered by the present invention. Although not intended to be complete, a number of possible variations will be now described.

The game board and playing surface provided thereon need not be of square shape but may be of substantially any shape; preferably, however, with all sides being of equal length and with all corner angles being equal. Similarly, the subunits need not be squares, and the number of subunits can be varied within wide limits. The number of subunits should be sufficient, however, to provide adequate maneuvering room for the players.

Each player can be provided with other than five counters; for example, from two to ten counters, and a varied number of RM pieces may be used, for example, from one to five RM pieces. If several RM pieces are used, several subunits on the board, for example, a centrally positioned array of subunits, can be designated as starting positions for the RM pieces.

The rules of the game may also be varied in many ways. For example, rather than moving to a space adjacent the RM piece, a counter could be required to interact with an RM piece by jumping over the RM piece. In such a situation, a counter would, for example, be allowed to jump an RM piece if the movement of the counter will place it no farther than two squares past the square where the RM piece is located.

The RM pieces could also be moved in a non-random manner with each player controlling at least one RM piece. In such a variation, all other rules of the game would remain the same except that each player will have another player's RM piece as his target. In this version, the movement of a player's target RM piece will still be unpredictable to the player.

Yet other variations would place the central square or central square section designated as the starting location for the RM piece or pieces off-limits to counters and A-pieces. Also, safety squares could be distributed throughout the board to facilitate the exit of the A-pieces. It could also be allowed to have an RM piece "kill" a counter or A-piece or to allow A-pieces to kill other players' counters.

The game board could also be provided with a playing surface in which the subunits are defined by a large number of points arranged in some regularly spaced pattern, either connected to one another by straight lines or not connected.

Yet another version involves altering the sequence of play such that before a player's turn, that player would throw dice 33 three times to determine the distance of the RM piece's moves, but not throw to determine direction. All the players then take their turns throwing dice 31 and 32 and moving their own counters, and, after making their moves, the first player throws die 34 three times to determine the direction of movement of the RM piece, matches his throws of dice 33 and 34 and then moves the RM piece.

The object in this game version is for each player to be required to move his counters without knowing where the RM piece will ultimately end up following a round of play, thereby attempting to position his counters based upon estimates of where that point will be. In this version, each player is allowed an additional throw of dice 31 and 32 after the RM piece moves; otherwise, achievement status could result only from the RM piece's move. In this version, also, the players take turns in throwing for the RM piece.

It should also be recognized that the game of the present invention is suitable for use in a video game version or in a version similar to a computerized chess game that involves an actual playing board as opposed to a video screen. In such versions, a computer controls the movement of the RM piece or pieces while the players control the movement of their own pieces. The term "game board" as used herein is intended to include depictions of a game board on a TV monitor or the like.

A solitaire version or a three-dimensional version of the game is also possible. In a three-dimensional version, die 34 would have additional sides to also designate other possible directional movements of the RM piece.

While what has been described constitutes a presently preferred embodiment of the invention and several possible variations thereof, it should be recognized, as indicated above, that numerous other variations are also possible. It should be understood, therefore, that the invention is to be limited only insofar as is required by the scope of the following claims.

I claim:

1. A method for playing a board game which includes a game board having a playing surface having a plurality of subunits thereon, one or more random movement pieces movable periodically from subunit to subunit in an unpredictable manner during the course of a game, one or more counters for each player of the game which are movable from subunit to subunit during the course of the game toward an objective which includes an interaction with one of the one or more random movement pieces, first designating means for designating the number of subunits of movement of at least one of the one or more counters, and second designating means for designating the number of subunits of movement and the direction of movement of the at least one random movement piece; the method comprising:

A. each player of the game in sequence taking a turn by operating the first designating means to designate the number of subunits of movement of at least one of his one or more counters, the player thereafter moving the at least one of his one or more counters by the number of subunits designated by the first designating means in a direction of his choice;

B. each player, in sequence, operating the second designating means to designate the movement of at least one of the one or more random movement pieces and moving the at least one of the one or more random movement pieces by the number of subunits and in the direction designated by the second designating means; and repeating steps A and B until one player achieves the objective with each of his one or more counters.

2. The method of claim 1 wherein said interaction comprises moving a counter to a subunit adjacent the subunit on which one of said one or more random movement pieces is located.

3. The method of claim 2 wherein said objective further includes moving a counter to an exit subunit on said playing surface after said interaction.

4. The method of claim 1 and further including the step of assigning an achievement status to a counter after said interaction.

5. The method of claim 4 wherein said assigning step comprises replacing a counter with an achievement piece.

6. A method for playing a board game which includes a game board having a playing surface having a plurality of subunits thereon, one or more random movement pieces movable periodically from subunit to subunit in an unpredictable manner during the course of a game, one or more counters for each player of the game which are movable from subunit to subunit during the course of the game toward an objective which includes an interaction with one of the one or more random movement pieces, first designating means for designating the number of subunits of movement of at least one of the one or more counters, and second designating means for designating the number of subunits of movement and the direction of movement of the at least one random movement piece; the method comprising:

A. each player of the game in sequence taking a turn by operating the first designating means to designate the number of subunits of movement of at least one of his one or more counters, the player thereafter moving the at least one of his one or more counters by the number of subunits designated by the first designating means;

B. periodically, during the course of the game, operating the second designating means to designate the movement of at least one of the one or more random movement pieces and moving the at least one of the one or more random movement pieces by the number of subunits and in the direction designated by the second designating means; and repeating steps A and B until one player achieves the objective with each of his one or more counters.

7. The method of claim 6 wherein each player moves the at least one of his one or more counters in a direction of his choice.

8. The method of claim 6 wherein said interaction comprises moving a counter to a subunit adjacent the subunit on which one of said one or more random movement pieces is located.

9. The method of claim 8 wherein said objective further includes moving a counter to an exit subunit on said playing surface after said interaction.

10. The method of claim 6 and further including the step of assigning an achievement status to a counter after said interaction.

11. The method of claim 10 wherein said assigning step comprises replacing a counter with an achievement piece.

12. The method of claim 6 wherein said second designating means is operated and said at least one of the one or more random movement pieces is moved following the turn of each player of the game.

* * * * *